United States Patent [19]

Ishikawa et al.

[11] Patent Number: 4,822,252

[45] Date of Patent: Apr. 18, 1989

[54] VARIABLE CAPACITY COMPRESSOR

[75] Inventors: Hiroshi Ishikawa, Nagoya; Hidetaka Shingai, Anjo, both of Japan

[73] Assignee: Nippondenso Co., Ltd., Kariya, Japan

[21] Appl. No.: 74,063

[22] Filed: Jul. 16, 1987

[30] Foreign Application Priority Data

Jul. 28, 1986 [JP] Japan ..... 61-177104
May 20, 1987 [JP] Japan ..... 62-124138

[51] Int. Cl.[4] ..... F04B 1/26
[52] U.S. Cl. ..... 417/222; 417/269
[58] Field of Search ..... 417/222 S, 269

[56] References Cited

U.S. PATENT DOCUMENTS

| | | | |
|---|---|---|---|
| 3,861,829 | 1/1975 | Roberts et al. | 417/222 S |
| 4,533,299 | 8/1985 | Swain | 417/222 S |
| 4,704,072 | 11/1987 | Nakajima | 417/269 |
| 4,712,982 | 12/1987 | Inagaki | 417/222 S |
| 4,732,544 | 3/1988 | Kurosawa | 417/222 S |
| 4,737,079 | 4/1988 | Kurosawa | 417/222 S |

FOREIGN PATENT DOCUMENTS

| | | | |
|---|---|---|---|
| 219283 | 4/1987 | European Pat. Off. | 417/222 S |
| 58-15112 | 1/1983 | Japan . | |
| 60-33002 | 2/1985 | Japan . | |
| 60-162087 | 8/1985 | Japan . | |

*Primary Examiner*—William L. Freeh
*Attorney, Agent, or Firm*—Cushman, Darby & Cushman

[57] ABSTRACT

A compressor includes a plurality of pistons, a shaft and a wobble plate rotatably and swingably connected with said shaft so that the pistons are reciprocated in accordance with the wobbling movement of the wobble plate. The capacity of the compressor is varied in accordance with the inclining angle of the wobble plate. The actual capacity of the compressor is detected by the magnetic sensor. The compressor has a through member at the lower most portion of the pressure chamber provided in the housing and the slider is slidably connected with the through member. The slider also rotatably connected with the wobble plate so that the wobbling movement of the wobble plate makes the slider reciprocate along with the through member. Such movement of the slider is detected by the magnetic sensor.

16 Claims, 6 Drawing Sheets

VARIABLE CAPACITY COMPRESSOR

The present invention relates to a variable volume compressor which is used as a compressor for compressing coolant for an automotive cooler, for example.

BACKGROUND OF THE INVENTION

A wobble type compressor having a wobble plate and a plurality of pistons slidably provided within cylinders and functionally connected to the wobble plate is used as the compressor for automotive air conditioners. It has been known for the wobble type compressor that the inclining angle of the wobble plate is varied in order to change the reciprocating stroke of the piston (U.S. Pat. No. 3,861,829).

Though such a type of variable volume wobble compressor can vary the volume in accordance with the inclining angle of the wobble plate, the inclining angle of the wobble plate is hard to controll. Since the inclining angle of the wobble plate is controlled in accordance with the pressure within a housing, and since it is difficult to change the pressure within the housing, conventional type of the variable volume wobble type compressor is difficult to control accurately. Namely, there must exist some time lag between the timing when the control pressure is introduced into the housing and the timing when the wobble plate inclines the desired inclining angle, and such a time lag cannot be estimated accurately.

Therefore, a positioning sensor which can sense the position of the wobble plate is desired.

Since the conventional type of positioning sensor using a magnet can sense only a small distance (3 mm for example), the conventional type sensor cannot be used for sensing the position of the wobble plate. Another type of positioning sensor using a photosensor is also hard to use with the compressor, because the photosensor must be provided within the housing and because the operation of the photosensor is hindered by the lubricant oil or any other foreign object within the housing.

SUMMARY OF THE INVENTION

An object of the present invention is to provide a variable volume compressor having a positioning sensor which detects the position of an wobble plate.

In order to attain the above object, the present invention employs a through member within a cover housing, a wobble plate and an inclining plate are provided within the cover housing. A slider is connected with the through member in such a manner that the slider can slide along with the through member, the slider is rotatably connected with the wobble plate. Since the wobble plate is wobbled within the cover housing in accordance with the rotation of the inclining plate, the slider can reciprocate along with the through member in accordance with the movement of the wobble plate. A magnet is connected with the slider in such a manner that the direction of the flux of the magnet is identical with the longitudinal axis of the through member. A plurality of magnetic sensors are provided in such a manner that each of the magnetic sensors faces the slider when the slider moves along with the through member.

So that the movement of the magnet can be sensed by the magnetic sensor. Since a plurality of magnetic sensors are arranged in a line, the reciprocating stroke of the slider can be calculated by distinguishing the magnetic sensor which senses the magnet. Since the compressor of the present invention is sensed the position of the wobble plate by magnetic sensor, the reciprocating stroke of the wobble plate can be sensed even though the wobble plate is located within the lubricant oil.

DETAIL DESCRIPTION OF THE PREFERRED EMBODIMENT

Figure 1:
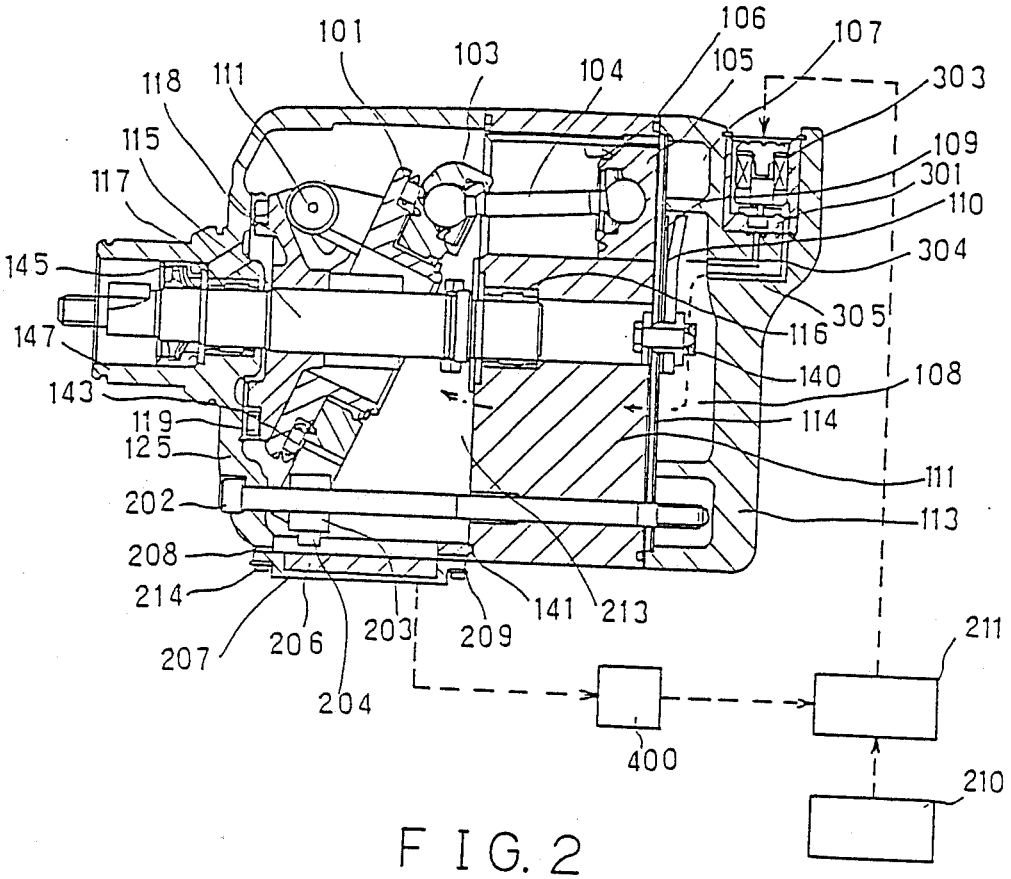
FIG. 1 is a sectional view showing a compressor of the present invention.

The first embodiment of the present invention is described hereinafer. The numeral 111 in FIG. 1 shows a cylinder housing made of aluminum alloy and, a plurality of cylinders 106 are formed within the cylinder housing 111. A piston is slidably provided within each of cylinders 106. A rear housing 123 is fixed to the first end portion of the cylinder housing 111 via a valve plate 114. A suction chamber 107 and a discharge chamber 111 are formed within the rear housing. A suction valve is provided on the valve plate 114 so that the coolant within the suction chamber 107 can be sucked toward the cylinder 106 through the suction valve. A discharge valve 109 is also provided on the valve plate 114, and the discharge valve 109 and a valve cover 110 are fixed on the valve plate 114 by a bolt 140. Since the discharge valve 109 can open and close a discharge port formed in the valve plate 104, the coolant compressed within the housing 106 is discharged toward the discharge chamber 108 through the discharge port.

A cover housing 125 is fixed to another end portion of the cylinder housing via an 0-ring 141. Rotating mechanisms such as a rotating plate 101 and a wobble plate 103 are provided within the cover housing. A shaft 115 is rotatably supported in the cover housing 125 by journals 116 and 117. A rotating member 118 is fixed to the shaft 115 so that the rotating member 118 and the shaft 115 rotate in synchranism. The thrust force added to the rotating member 118 is supported by a thrust bearing 119. The rotating plate 101 is connected to the rotating member 118 via a pin 1011.

Since the rotating plate 101 is inclined, the rotating plate 101 wobbles when the rotation of the shaft 115 is transmitted thereto. The wobble plate 103 is connected on the rotating plate 101 via a bearing 143 so that the wobble plate 103 cannot rotate even when the rotating plate 101 rotates. Thereby the wobble plate 103 wobbles within a pressure chamber 213 without any rotation when the rotation of the shaft 115, and is transmitted;

and the to the wobble plate 111 via the rotating plate 101. The wobble movement is transmitted to the piston 105 via a rod 104. Since the rod 104 is rotatably connected with the wobble plate 103 via a ball shaped portion formed at one end of the rod 104, and since the rod 104 is also rotatably connected with the piston 105 via a ball shaped portion formed at another end of the rod 104, the wobble movement of the wobble plate 103 makes the piston 105 reciprocate.

Since the rotating plate 101 is connected to the rotating member 118 via the pin 111, angle of inclination of the rotating plate 101 can be varied. The reciprocating stroke of the piston 105 is varied in accordance with the inclining angle of the rotating plate. Namely, the reciprocating movement becomes larger when the inclining angle of the wobble plate is large. The reciprocating movement of the piston, on the other hand, becomes small when the inclining angle of the rotating plate 101 becomes small. Accordingly the reciprocating stroke can be controlled in accordance with the angle of inclination of the rotating plate.

A shaft seal 145 which prevents the leakage of the coolant within the pressure chamber 213 along with the shaft 115 is provided within the cover housing 125. A cylindrical hub portion 147 on which an electromagnetic clutch (not shown) is mounted is formed at the center portion of the cover housing 125. The rotating movement of the automotive engine is transmitted toward the shaft 115 via the electro magnetic clutch.

The inclining angle of the wobble plate 103 is varied in accordance with the pressure within the pressure chamber 213. The high pressure is added toward the back portion of the piston 105 when the pressure within the pressure chamber 213 becomes high so that such high pressure makes the reciprocating stroke of the piston 105 short. The pressure added on the back side of the piston 105 becomes small when the pressure within the pressure chamber 213 reduces so that such small pressure causes the reciprocating stroke of the piston 105 to become large. Accordingly, the reciprocating movement of the piston 105 and the inclining angle of the wobble plate 103 can be controlled when the pressure within the pressure chamber 213 is controlled.

Figure 9:
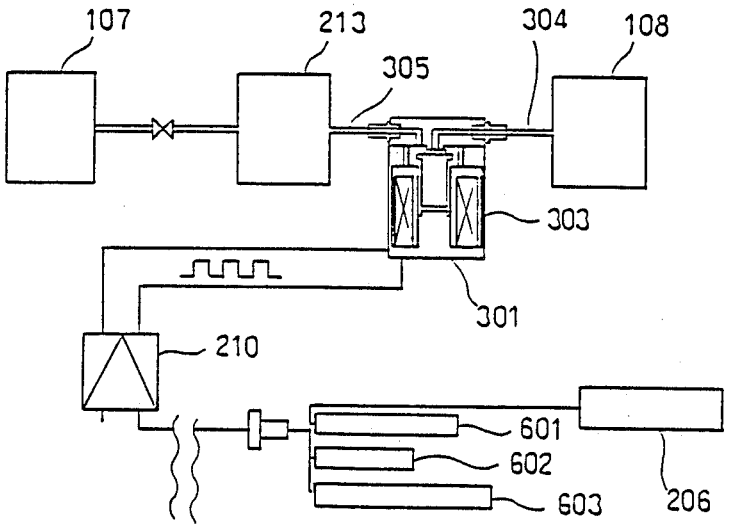
FIG. 9 is a schematic view showing an electric connection of a magnetic valve.

The pressure within the pressure chamber 213 is controlled via a control valve 301. The control valve 301 is provided in the rear housing 113, and the control valve 301 receives discharge pressure within the discharge chamber 108 and the suction pressure within the suction chamber. The control valve 301 modulates the output pressure which is introduced into the pressure chamber 213. An electra magnetic valve 303 provided within the control valve 301 is controlled to set the proportion of the timing during which the electro magnetic valve 303 opens a high pressure path 304 which is connected to the discharge chamber 108 and the timing when the electro magnetic 303 closes the high pressure chamber 304 so that the output pressure which is introduced into the pressure chamber 213 via a output path is modulated (as shown in FIG. 9). The output path 305 is formed within the rear housing 113 and the cylinder housing 111.

Figure 2:
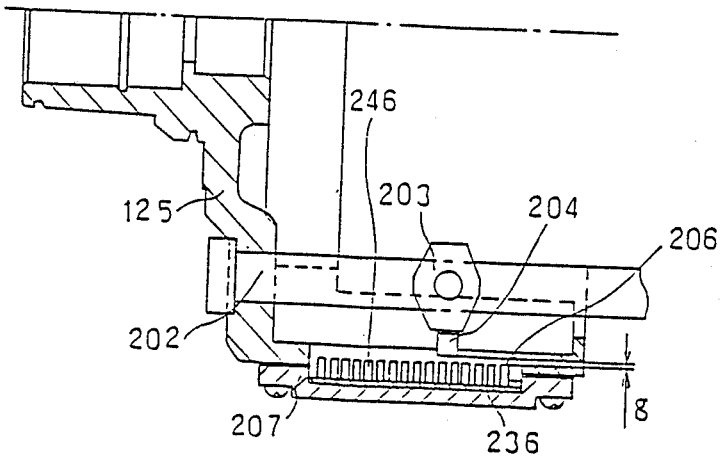
FIG. 2 is a sectional view showing a part of the compressor shown in FIG. 1.
Figure 3:
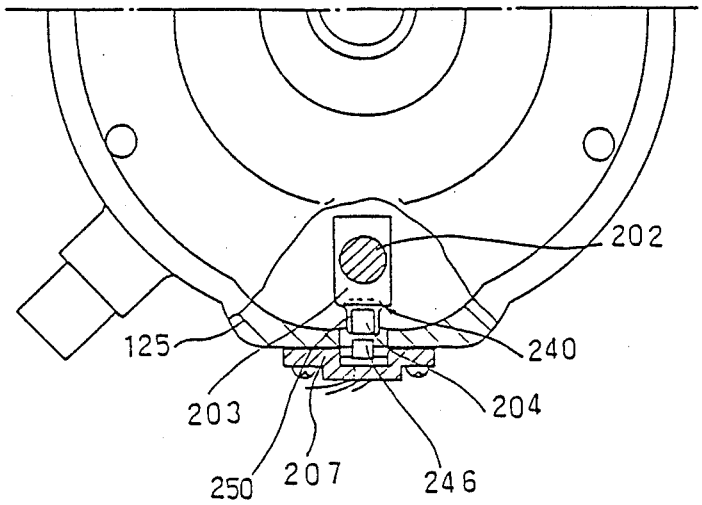
FIG. 3 is a sectional view taken along with III—III line of FIG. 2.

The cover housing 125, the cylinder housing 111 and the rear housing 113 are connected each other via a plurality of through bolts 202. A slider 203 is slidably connected on the through bolt 202 which locates lower most portion of the housing. The slider 203 is also rotatably connected with the wobble plate 103 as shown in FIGS. 2, 3 and 10.

Figure 10:
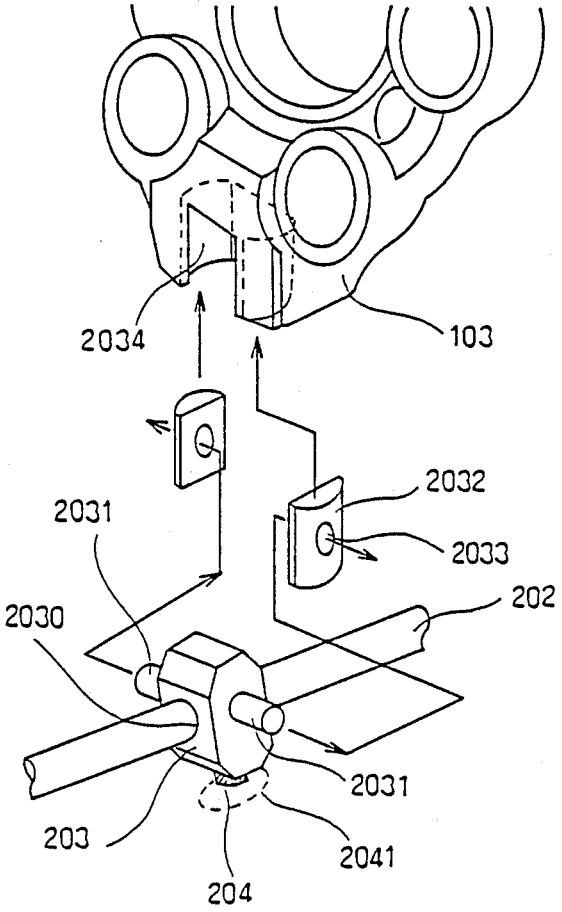
FIG. 10 is a perspective view showing a slider shown in FIG. 1.

FIG. 10 shows a through hole 2030 through which the through bolt 202 is inserted is formed at the central portion of the slider 203. A connecting pin 2031 which is inserted into a connecting hole 2033 formed in a shoe 2032 is formed at a side portion of the slider 203 so that the slider 203 is rotatably connected with the shoe 2032. The shoe 2032 is slidably held within a sliding groove 2034 formed in the lower most portion of the wobble plate 103. The relative movement between the wobble plate 103 and the through bolt 202 can be compensated by the reciprocating movement of the shoe 2032 and the rotation of the slider 203. Since the slider 203 locates the lower most portion of the pressure chamber 213, the lubricant oil filled in the pressure chamber 213 lubricates the gap between the slider 203 and the through bolt 202, the gap between the slider 203 and the shoe 2032 and the gap between the shoe 2032 and the sliding groove 2034. A magnet 204 is fixed on the lower most surface of the slider 203. The direction of the flux between N pole to S pole is identical with the longitudinal axis of the through bolt 202; and thereby the direction of the flux 2041 of the magnet 204 is identical with the moving direction of the slider 203.

A magnetic sensor has a base plate 236 fixed on a sensing housing 207 and a plurality of hole IC 246 provided on the base plate 236. The sensor housing 207 is fixed to the cover housing 125 via a packing 208 and a washer by a bolt 214. A slight gap g is formed between the hole IC 246 and the top end of the magnet 204. The gap g is controlled to be between a predetermined width of 0.5 mm–1.5 mm with the gap of 0.8 mm being preferred. A magnetic housing 250 is fixed to the slider 203 by a mataric adhesive, and the magnet 204 is fixed to the magnet housing 250 by caulking.

Figure 4:
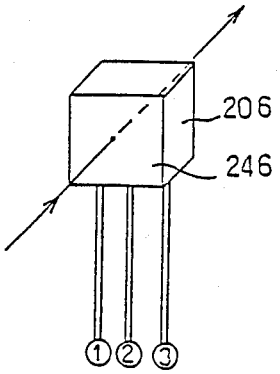
FIG. 4 is a perspective view showing hole IC.

As shown in FIG. 4, the hole IC 206 is rectangular, and the width of the hole IC is about 4–4.5 mm and the thickness thereof is about 2 mm. The hole IC 246 is so provided that a detecting surface 2461 thereof is perpendicular with the flux 2041. Thereby, a plurality of hole ICS 246 make a line in such a manner that the detecting surface 2461 of an one hole IC faces to the detecting surface 2461 of adjacent hole IC 246.

The hole IC 246 of the magnetic sensor 206 is explained hereinafter. As shown in FIG. 4, hole IC 246 has three terminals 1, 2 and 3, the first terminal 1 is connected to the automotive battery via a converter so that a voltage (5 Vt) is supplied thereto, the third terminal 3 is grounded to the automotive body, and output voltage (5 Vt) is output to the second terminal 2 when a predetermined amount of flux 2041 is passed through the hole IC 246.

Figure 5:
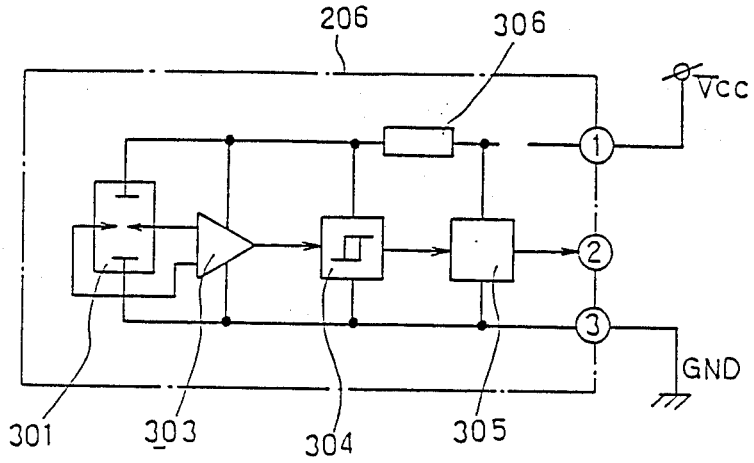
FIG. 5 shows an electric circuit within the hole IC.

The structure of the hole IC 246 is described in FIG. 5. Hole IC element 301 which outputs the output voltage is provided within the hole IC 246. The output voltage is supplied to a trigger 304 after the output voltage is amplified by an amplifier 303. The output voltage is transferred to 0 or 1 by the trigger 304. Namely, the trigger 304 generates a "1" pulse when the amount of flux is less than the predetermined value (500 Gauss) and the trigger 304 generates a pulse when the amount of the flux becomes higher than the predetermined value. The output signal generated by the trigger 304 is transferred to the second terminal 2 via an output stage 305. A voltage regulator 306 is connected between the trigger 304 and the output, stage 505.

Figure 6:
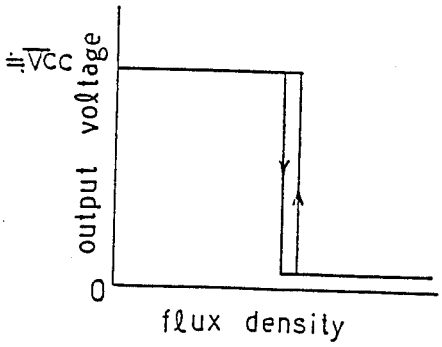
FIG. 6 shows the relationship between the flux density and the output voltage of the hole IC.
Figure 7:
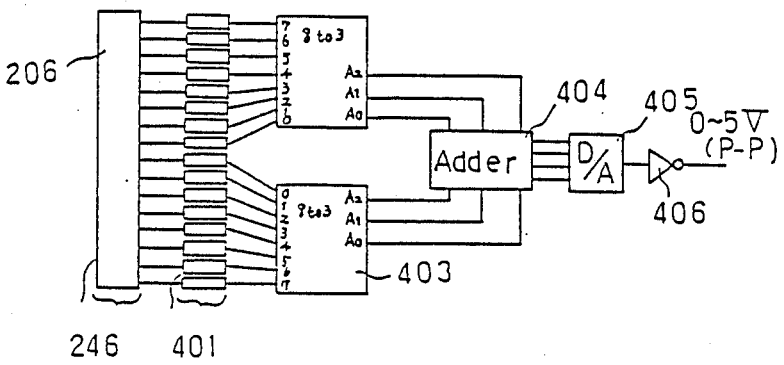
FIG. 7 shows a detecting circuit used for the compressor shown in FIG. 1.

FIG. 6 shows a characteristic curve of the hole IC. The output voltage becomes 0 when the density of the flux becomes higher than the predetermined value 500

(Gauss). Pulse signals generated from the hole IC 246 is maintained a predetermined time by a one shot IC. The predetermined time is calculated using the rotating speed of the compressor as a parameter. When the compressor rotates 720 RPM, which is the idling condition of the automotive engine, the predetermined time is calculated as being 90 mSec by the following equation: 720/60 rpm the second = 12 Hz 720/60 rpm/Sec = $12H_z$. Since the slider 203 reciprocates within the pressure chamber 213, the output voltage should be maintained while the period after the slider passed through the hole IC and before the slider returns to the hole IC 246.

Figure 8:
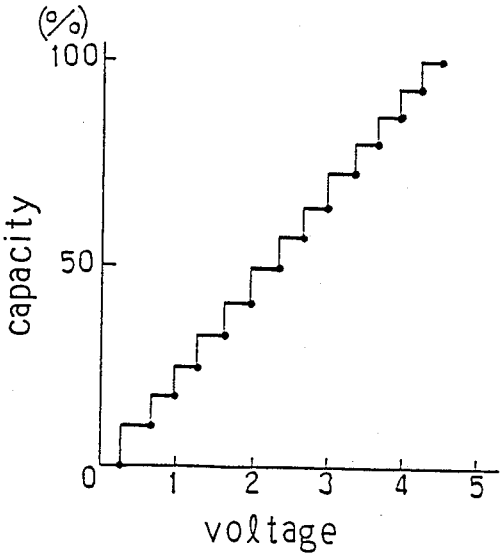
FIG. 8 shows the relationship between the output voltage of the detecting circuit and the volume of the compressor.

The output signal is supplied to an encoder 403 so that the signals from the one shot IC 400 is exchanged to a 0 or 1 signal. The changed signal is then supplied to an adder 404 in order to add the signal from one encoder to the signal from another encoder 403. Numeral 405 shows a digital to analog converter and numeral 406 shows an amplifier. The signal from the amplifier 406 has the characteristic shown in FIG. 8. Namely the circuit 400 generates the signal in accordance with the signal from the hole IC. Since the signal from the hole IC 246 designates the reciprocating stroke of the slider 203, and since the reciprocating length of the slider designates the inclining angle of the wobble plate 103, the output signal from the circuit 400 designates the capacity of the compressor.

An output signal from the circuit 400 is introduced into the electric control unit 211. The signal from air conditioning electric control unit 210 is also introduced into the electric control unit 211 so that the preferred volume of the compressor is calculated within the electric control unit 211. When the signal from air conditioning circuit 210 indicates a shortage of the cooling capability, the signal is supplied to the control valve 301 in order to maximize the volume of the compressor. The difference between the preferred volume of the compressor calculated by the electric control unit and the actual volume of the compressor detected by the circuit 400 is fed back to the electric control unit in order to modulate the capacity of the compressor.

As shown in FIG. 9, not only the positioning sensor, but also the other sensors sensing the condition of the air conditioner such as pressure sensor 601 which detects the discharge pressure form the compressor, a temperature sensor which detects the temperature of the atmosphere within the passenger's compartment and an accelerating sensor 603 which detects the accelerating operation of the automotive engine are provided, and the electric signal from these sensors are supplied to the air conditioning electric control unit 210. The air conditioning electric control unit 210 controls the duty ratio in cooperation with the electric signals. Since the actual compressor capacity is detected by the pressure sensor 206 and such signal is fed back to the electric control unit 210, the electric control unit 210 can control the capacity of the compressor accurately and quickly.

As described above, since the compressor of the present invention employs the through member within the pressure chamber, and since the slider is slidably connected with the through member, the slider and the through member can be lubricated by the lubricant oil within the pressure chamber so that the slider can slide smoothly. Since the magnet is provided at the end portion of the slider in such a manner that the direction of the flux is identical with the direction of the reciprocating movement of the slider, and since the flux is perpendicular to the sensing surface of the magnetic sensors, a plurality of magnetic sensor can be provided along with the direction of the reciprocating movement of the slider so that the position of the slider can be detected by the magnetic sensor.

What is claimed is:

1. A variable capacity compressor comprising of:

a cylinder housing having a plurality of cylinders each of which is parallel with each other, a cover housing connected to said cylinder housing having inner surfaces that form a pressure chamber between said cover housing and said cylinder housing, a shaft rotatably provided beneath said cover housing, a rotating member connected to said shaft so that said rotting member and said shaft rotate in synchronism, a rotating plate swingably connected with said rotating member so that said rotating plate wobbles within said pressure chamber when the rotation of said shaft is transferred to said rotating plate, a wobble plate rotatably supported on said rotating plate so that said wobble plate wobbles within said pressure chamber without rotation, a piston slidably provided within said cylinder, a rod connecting said piston to said wobble plate, a through member provided within said pressure chamber in such a manner said through member is parallel with said shaft, a slider slidably connected with said through member and rotatably connected with said wobble plate so that said slider reciprocates along with said through member when said wobble plate wobbles, a magnet connected to an end portion of said slider that a direction of flux connecting N pole and S pole of said magnet is the same as a direction of reciprocating movement of said slider, and a plurality of magnetic sensors facing said magnet.

2. A variable capacity compressor claimed in claim 1, wherein:

said plurality of magnetic sensors are arranged such that a detecting surface of each of said magnetic sensors faces to each other.

3. A variable capacity compressor claimed in claim 1, wherein:

said magnetic sensor includes a hole IC having hole IC having hole IC elements, an amplifier and a trigger.

4. A variable capacity compressor claimed in claim 1 wherein:

said through member is provided at a lowest portion of said pressure chamber.

5. A variable capacity compressor claimed in claim 1, further comprising:

control means for controlling pressure within said pressure chamber between discharge pressure and suction pressure.

6. A variable capacity compressor as claimed in claim 5, wherein said control means includes a high pressure path for introducing the discharge pressure, a low pressure path for introducing the suction pressure and a controlling pressure path connected to said pressure chamber and an electro magnetic valve for closing and opening said high pressure path so that the pressure introduced into said control pressure path is controlled in accordance with the operation of said electro magnetic valve.

7. A variable capacity compressor claimed in claim 5, wherein said control means includes an electro magnetic valve for controlling the pressure supplied to said pressure chamber.

8. A variable capacity compressor claimed in claim 5, further comprising:

an electric control unit for supplying a control signal to said control means in accordance with a condition of a refrigerant circuit connected to said compressor, wherein an electric signal from said magnetic sensor is fed back to said electric control unit in order to modulate the signal supplied to said control means.

9. A variable capacity compressor comprising of:

a cylinder housing having a plurality of cylinders each of which is parallel with each other, a cover housing connected to said cylinder housing having inner surfaces that form a pressure chamber between said cover housing and said cylinder housing, a shaft rotatably provided within said cover housing, a rotating member connected to said shaft so that said rotating member and said shaft rotate in synchronism, a rotating plate swingably connected with said rotating member so that said rotating plate wobbles within said pressure chamber when the rotation of said shaft is transferred to said rotating plate, a wobble plate rotatably supported on said rotating plate so that said wobble plate wobbles within said pressure chamber with out rotation, a piston slidably provided within said cylinder, a rod connecting said piston to said wobble plate, a linearly extending through member provided within said pressure chamber in such a member that said through manner is parallel with said shaft, a slider mounted on said through member for linear movement therewith and rotatably connected with said wobble plate so that said slider reciprocates along with said through member when said wobble plate wobbles, a magnet so connected to an end portion of said slider that a direction of flux connecting N pole and S pole of said magnet the same as a direction of reciprocating movement of said slider, and a plurality of magnetic sensors facing said magnet.

10. A variable capacity compressor claimed claim 9, wherein:

said plurality of magnetic sensors are so arranged that a detecting surface of each of said magnetic sensor face each other.

11. A variable capacity compressor claimed in claim 9, wherein:

said magnetic sensor includes a hole IC having hole IC elements, an amplifier and a trigger.

12. Variable capacity compressor claimed in claim 9, wherein:

said through member is provided at a lowest portion of said pressure chamber.

13. A variable capacity compressor claimed in claim 9, further comprising:

control means for controlling pressure within said pressure chamber between discharge pressure and suction pressure.

14. A variable capacity compressor claimed in claim 13, wherein, said control means includes a high pressure path introducing the discharge pressure, a low pressure path introducing the suction pressure and a controlling pressure path connected to said pressure chamber and an electro magnetic valve for closing and opening said high pressure path so that the pressure introduced into said control pressure path is controlled in accordance with the operation of said electro magnetic valve.

15. A variable capacity compressor claimed in claim 13, wherein, said control means includes an electro magnetic valve for controlling the pressure supplied to said pressure chamber.

16. A variable capacity compressor claimed in claim 13, further comprising:

an electric control unit for supplying a control signal to said to control means in accordance with a condition of a refrigerant circuit connected to said compressor, wherein an electric signal from said magnetic sensor is feed backed to said electric control unit in order to modulate the signal supplied to said control means.

* * * * *